US005778586A

United States Patent [19]

Carlson

[11] Patent Number: 5,778,586

[45] Date of Patent: Jul. 14, 1998

[54] FIREARM TRIGGER SAFETY DEVICE

[76] Inventor: Ronald G. Carlson, 301 SE. 54, Oklahoma City, Okla. 73129

[21] Appl. No.: 931,079

[22] Filed: Sep. 15, 1997

Related U.S. Application Data

[63] Continuation of Ser. No. 778,435, Jan. 2, 1997, abandoned.

[51] Int. Cl.[6] ..... F41A 17/54

[52] U.S. Cl. ..... 42/70.07

[58] Field of Search ..... 42/70.06, 70.07, 42/70.11

[56] References Cited

U.S. PATENT DOCUMENTS

| | | | |
|---|---|---|---|
| 2,444,649 | 7/1948 | Jacobs | 42/70.07 |
| 2,742,726 | 4/1956 | Feller | 42/70.07 |
| 4,030,221 | 6/1977 | Doobenen et al. | 42/70.07 |
| 4,723,370 | 2/1988 | Sheehan | 42/70.07 |
| 4,916,842 | 4/1990 | Hardy | 42/70.07 |
| 5,075,994 | 12/1991 | Nishioka | 42/70.07 |
| 5,191,158 | 3/1993 | Fuller et al. | 42/70.07 |
| 5,560,135 | 10/1996 | Ciluffo | 42/70.07 |

FOREIGN PATENT DOCUMENTS

| | | | |
|---|---|---|---|
| 350867 | 6/1905 | France | 42/70.07 |

*Primary Examiner*—Stephen M. Johnson
*Attorney, Agent, or Firm*—Robert K. Rhea

[57] ABSTRACT

A trigger safety device for a firearm having a trigger pivotal within a trigger guard on the firearm is formed by an integral end, side wall and bight portion body forming a socket substantially enveloping the trigger guard and including J-shaped hook means engaging the trigger guard and supported by the side walls with an axial compression spring biasing the hook means into engagement with the trigger guard.

8 Claims, 2 Drawing Sheets

FIREARM TRIGGER SAFETY DEVICE

This application is a continuation of application Ser. No. 08/778,435, filed Jan. 2, 1997, now abandoned.

This invention relates generally to firearms and more particularly to a trigger shielding device preventing access to the trigger of a firearm by anyone other than an adult.

BACKGROUND OF THE INVENTION

Many households have handguns for personal protection and in most of these households the guns are loaded for instant use. A loaded gun in a household, particularly where children are present, may create a dangerous situation. Most handguns in households are kept in drawers or cabinets and easily accessible by children when unattended with many times tragic results. When children are in a household most gun owners seek to immobilize the gun with respect to the children. However, it is desirable that the gun be readily available in an emergency without the necessity of having to search for a key and fit it in the keyhole and remove a lock from the gun. Therefore, many gun owners forego the safety of a lock and risk the hazards of accidents with children.

This invention, it is believed, effectively overcomes the problem of not having ready or instant access to a gun in an emergency and yet prevents access to the trigger of a gun from anyone other than an adult.

SUMMARY OF THE INVENTION

In a preferred embodiment an upwardly open socket formed by integrally joined end, sidewalls and a bight portion envelopes the major portion of a trigger guard projecting from a firearm. J-shaped hook means including a stem portion projecting through opposite side walls of the socket adjacent its bight portion underlies a trigger guard when in trigger guard enveloping relation. The hook of the J-shape projects through the body wall opposite the stem and overlies the trigger guard opposite the position of the stem. A strong compression spring surrounds that portion of the J-shape hook stem projecting outwardly of the body wall grips the trigger guard until sufficient pressure is axially applied to the spring to fully compress it and release the socket from the trigger guard.

In a second embodiment one end wall is omitted from the socket forming body for abutting the pistol grip of a 9mm revolver. In the second embodiment the J-shaped hook means similarly grips the trigger guard. In both embodiments a side and end wall extending member is adjustably connected with the side walls of the socket forming body.

The principal objects of this invention are to: provide a protective safety device for the trigger of a firearm which prevents removal of the device by anyone other than an adult; provide a safety device for firearm triggers which is relatively inexpensive and easy to manufacture and may be easily carried in a pocket or purse; provide a trigger shield and clamp for a trigger guard which is adaptable to a wide variety of guns sizes, types and trigger guard shapes; and provide a safety guard for a firearm trigger which may be quickly and safely removed by adults in times of emergency.

DESCRIPTION OF THE PREFERRED EMBODIMENTS

Figure 1:
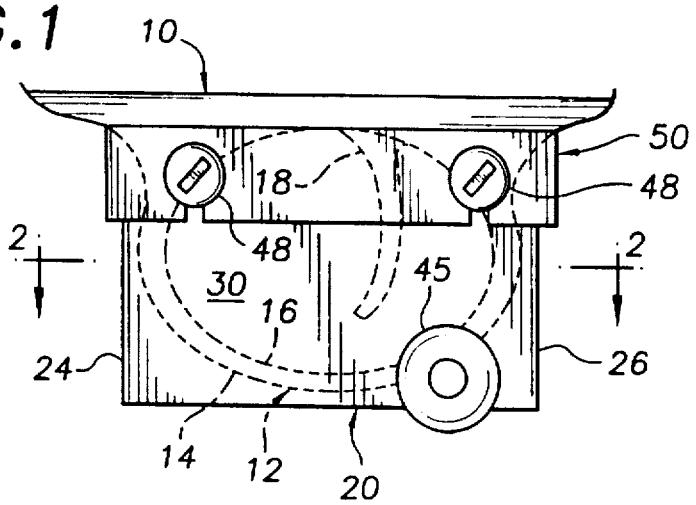
FIG. 1 is a fragmentary side elevational view of a preferred embodiment of the device installed on a firearm trigger guard.

Like character of reference designate like parts in those figures of the drawings in which they occur.

In the drawings:

Referring first to FIG. 1 the reference numeral 10 indicates a fragment of a firearm such as a rifle, revolver or most pistols having a trigger guard 12. The trigger guard 12 is generally ovate in side elevation having its major axis disposed in a forward to aft direction parallel with the barrel of the firearm, not shown. The trigger guard outer perimeter 14, at its upper forward and rearward upper limits, merges with the other structure of the firearm 10. The inner perimeter 16 of the trigger guard 12 is substantially ovate in side elevation and permits free front to rearward movement of the trigger 18 when manually moving the trigger in a firearm discharging action. The above description forms no part of the invention but is included to illustrate and describe the combination with which the present invention indicated at 20 is intended to be used to prevent other than an adult accessing the trigger 18.

Figure 2:
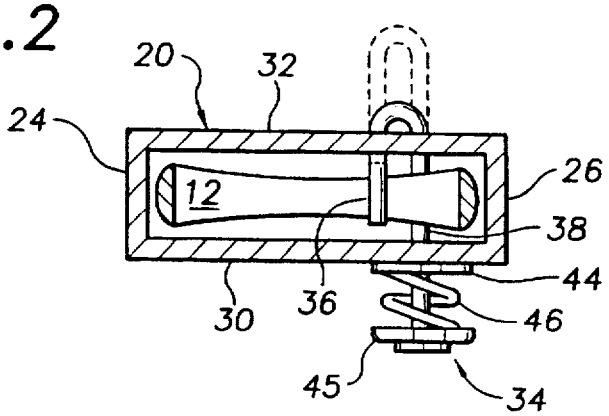
FIG. 2 is a horizontal cross-sectional view taken substantially along the line 2—2 of FIG. 1.
Figure 3:
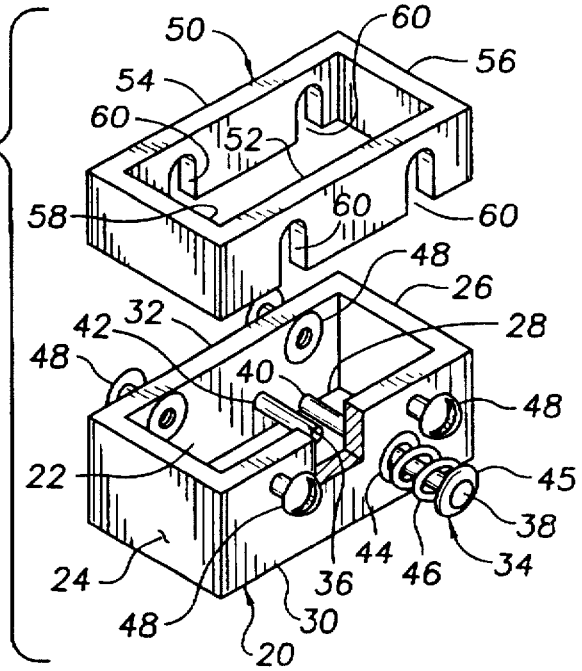
FIG. 3 is a perspective view with parts broken away for clarity of the trigger safety device.

Referring also to FIGS. 2 and 3 the trigger safety device 20 comprises an upwardly open socket 22 encompassing the trigger guard 12 formed by a body having end walls 24 and 26 confronting opposing end portions of the trigger guard perimeter 14 and integral with a bight portion 28 underlying the trigger guard 12 opposite the firearm. First and second parallel side walls 30 and 32 are respectively integral with the end walls 24 and 26 and with the bight portion 28 to substantially envelope the trigger guard 12 and preclude access to the trigger 18 by any person other than an adult. J-shaped hook means 34 having a hook portion 36 parallel with its longer stem 38 forms a trigger guard clamp or grip securing the safety device 20 to the trigger guard 12.

The side walls 30 and 32 are transversely line drilled, as at 40, adjacent the inner surface of the bight portion 28 for receiving the stem 38 of the J-shaped hook means 34. A second bore 42, formed in the side wall 32, slidably receives the hook 36 of the J-shaped hook means. The J-shaped hook stem 38 portion projecting beyond the first side wall 30, opposite the second side wall 32, is surrounded by a pair of spring keepers 44 and 45 with the spring keeper 45 secured to the end portion of the stem 38 opposite its hook portion. An expansion spring 46 is interposed between the spring keepers 44 and 45. The force required for completely collapsing the spring 46 is preferably about 6.80 kg (15 lbs).

The length of the hook 36 of the J-shaped hook means projecting into the confines of the socket 22 between the inner surfaces of the walls 30 and 32 is related to the length of the stem portion 38, projecting beyond the wall 30, so that when the spring 46 is completely compressed, as by forcing the spring keeper 45 toward the wall 30 (FIG. 2) the free end portion of the hook 36 projecting toward the spring will be adjacent the inner surface wall surface of the side wall 32. This permits free passage of the hook 36 of the J-shaped hook means with respect to the trigger guard 12 when the socket 22 is moved toward or away from the body of the firearm 10.

With the spring 46 compressed the socket 22 is disposed on the trigger guard 12 with the inner surface of the socket bight portion 28 adjacent the trigger guard 12. The spring compressing force is then released to allow the J-shaped hook 36 to be spring biased toward the inner surface of the side wall 30 thus disposing the stem 38 and hook 36 adjacent opposite surfaces of the trigger guard 12 and securing the device 20 to the firearm.

To compensate for the differences in dimensions between manufactures and models of guns the distance between the firearm and the perimeter 14 of the trigger guard 12 opposite the firearm, as measured in the direction of the trigger guard minor axis, an end and side wall unit 50 is provided for increasing the depth of the socket 22. The unit 50 is formed by parallel opposing side walls 52 and 54 integrally joined to end walls 56 and 58 forming an inner perimeter for the unit 50 slidably received by the upper outer surfaces of the end and side walls of the socket 22. Two pairs of nut and bolt means 48 are installed in suitable bores formed in the side walls 30 and 32 for slidably receiving downwardly open slots 60 formed in the adjustable side walls 52 and 54.

Figure 4:
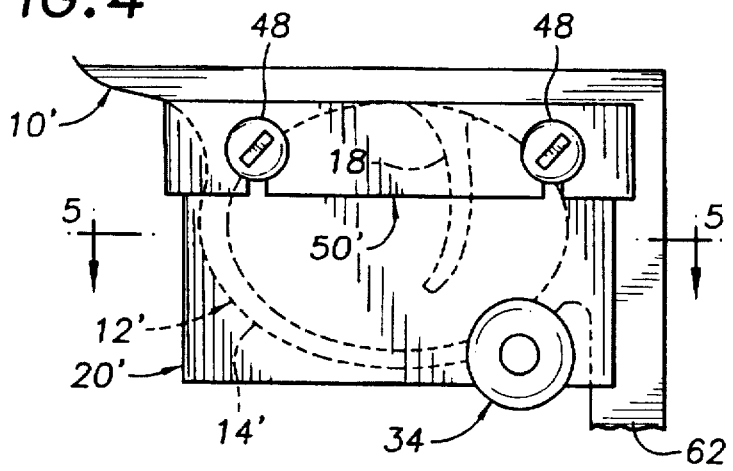
FIG. 4 is fragmentary side elevational view similar to FIG. 1 illustrating a second embodiment.
Figure 5:
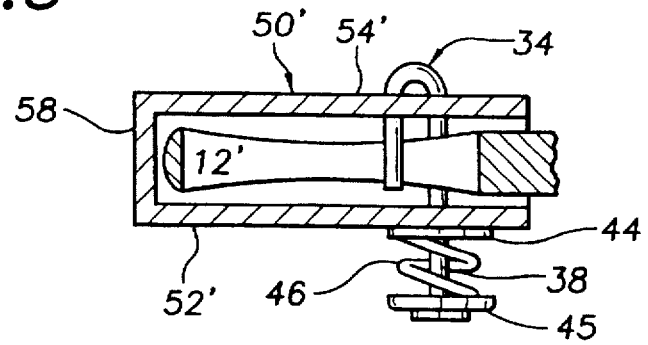
FIG. 5 is a vertical cross-sectional view taken substantially along the line 5—5 of FIG. 4; and, FIG. 6 is a perspective view substantially identical to FIG. 3 of the second embodiment.
Figure 6:
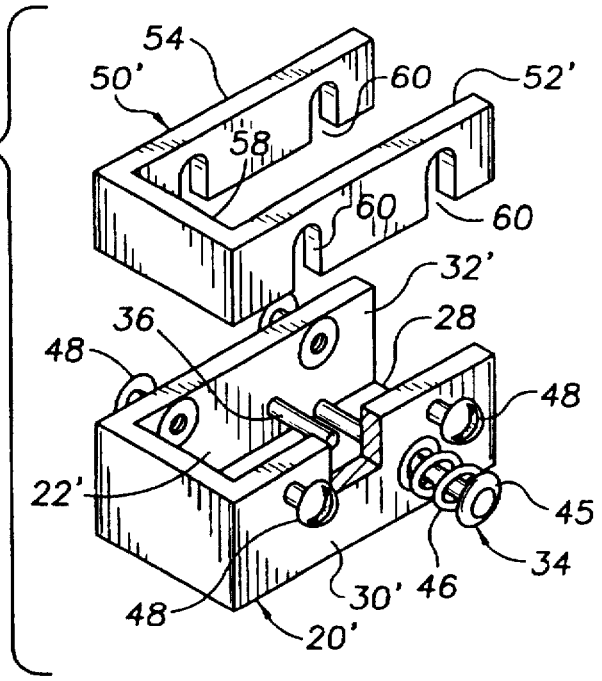

Referring now more particularly to FIGS. 4, 5 and 6 in which modified components have prime numerals, the reference numeral 10' indicates the body portion of a firearm commonly referred to as a 9 mm pistol having its trigger guard 12', particularly the outer perimeter 14', merging at its rearward major axis position with the handle or pistol grip 62 of the firearm 10'. In this embodiment the trigger safety device 20' omits the end wall 26 of the socket forming members and the wall 56 of the adjusting wall unit 50'.

The J-shaped hook means 34 is similarly disposed on opposite sides of the trigger guard 12'. The open end feature of the safety device 20' and the U-shaped side and end wall socket depth extension 50' permits the respective end portions of the several side walls to abut adjacent edges of the pistol grip 62.

Both embodiments of the safety device 20 and 20' may be easily attached to or removed from a firearm by an adult having the ability to compress the spring 46 without the necessity of searching for a key or a special tool to release the device. Simply compressing the spring 46 releases the Jshaped hook means 34 from the trigger guard 12 and permits separating the sockets 22 and 22' from the firearm.

Obviously the invention is susceptible to changes or alterations without defeating its practicability. Therefore, I do not wish to be confined to the preferred embodiment shown in the drawings and described herein.

I claim:

1. A trigger safety device for a firearm having a trigger pivotal within a trigger guard on the firearm, comprising: end and first and second side walls integral with a body bight portion forming a socket for substantially covering the trigger guard;

J-shaped hook means including a stem slidably projecting through said first and second side walls under the trig ger guard and beyond said first side wall and having a hook portion slidably projecting through said second side wall above the trigger guard; and, expansion spring means having a predetermined axial compression rating interposed between said first side wall and the end portion of said stem opposite said first side wall for normally precluding separation of said J-shaped hook means from said trigger guard.

2. The safety device according to claim 1 and further including:

other end and side wall members vertically slidably secured to said socket forming side walls for increasing the depth of the socket.

3. The safety device according to claim 2 in which said other end and side wall members form an endless unit.

4. A trigger safety device for a firearm having a trigger pivotal within a trigger guard on the firearm, comprising:

end and side walls integral with a body bight portion forming a socket for substantially covering the trigger guard;

J-shaped hook means having a stem slidably supported transversely by said side walls for gripping and releasing said trigger guard;

manually compressible expansion spring means securing said Jshaped hook to said trigger guard and, additional end and side wall members vertically slidably secured to said socket forming side walls for increasing the depth of the socket.

5. The safety device according to claim 4 in which the end and side wall members form a U-shaped unit.

6. A trigger safety device for a firearm having a trigger pivotal within a trigger guard on the firearm, comprising: end and side walls integral with a body bight portion forming a socket for substantially covering the trigger guard;

J-shaped hook means having a stem projecting transversely through and slidably supported by said side walls for gripping and releasing said trigger guard; and, manually compressible expansion spring means surrounding said stem outwardly of one said side wall for normally securing said J-shaped hook to said trigger guard.

7. The safety device according to claim 6 and further including:

additional end and side wall members vertically slidably secured to said socket forming side walls for increasing the depth of the socket.

8. The safety device according to claim 7 in which the end and side wall members form a U-shaped unit.

* * * * *